United States Patent [19]

Mulcahy

[11] 4,064,809

[45] Dec. 27, 1977

[54] ARTICULATED RAILWAY CAR TRUCK

[75] Inventor: Harry William Mulcahy, Griffith, Ind.

[73] Assignee: AMSTED Industries Incorporated, Chicago, Ill.

[21] Appl. No.: 648,112

[22] Filed: Jan. 12, 1976

[51] Int. Cl.[2] ..... B61F 3/08; B61F 3/16; B61F 5/30; B61F 5/40

[52] U.S. Cl. ..... 105/167; 105/169; 105/180; 105/182 R; 105/224 R

[58] Field of Search ..... 105/165, 180, 181, 182 R, 105/167, 169, 224 R

[56] References Cited

U.S. PATENT DOCUMENTS

| | | | |
|---|---|---|---|
| 113,878 | 4/1871 | Harrington | 105/180 |
| 495,189 | 4/1893 | Porter | 105/181 |
| 636,328 | 11/1899 | Frazier et al. | 105/180 |
| 1,707,046 | 3/1929 | Boyden | 105/165 |
| 3,768,419 | 10/1973 | Howard | 105/181 X |
| 3,802,352 | 4/1974 | Keller | 105/181 |
| 4,003,316 | 1/1977 | Monselle | 105/167 |

*Primary Examiner*—Robert J. Spar
*Assistant Examiner*—Howard Beltran
*Attorney, Agent, or Firm*—Fred P. Kostka

[57] ABSTRACT

There is provided an articulated four wheel truck for a railway freight car and the like, having independently rotatable wheels mounted at opposite ends of longitudinally spaced apart axle bolsters. A span bolster connects and mounts the axle bolsters for yawing movement about a vertical axis relative to the span bolster.

5 Claims, 5 Drawing Figures

ARTICULATED RAILWAY CAR TRUCK

BACKGROUND AND SUMMARY OF THE INVENTION

The present invention relates to a four wheel truck for a railway freight car and the like.

Modern freight car trucks are plagued by a wide variety of problems, both operational and in the area of maintenance. Some of these include truck hunting, which results in rapid and excessive wheel flange wear; excessive rotational restraining forces or torques which contribute to flange wear, and to wear of existing car body and truck center plates; car body roll and rock, resulting in structural damage to truck bolsters and car bodies, increased wear on these components, and wheel lifting; and suspension characteristics which accentuate the general self-destruct nature of the truck while also inflicting damage on lading and track structures.

A rigid wheel-axle set, having conventional tapered, conical, or otherwise profiled wheels, when displaced laterally of the center line of the track, executes two simultaneous motions; first, the wheel set moves toward its equilibrium (centered) position under the influence of gravity, and secondly, the high side wheel, rolling on a larger diameter than the low side wheel, moves along the rail faster than its partner, causing a yaw motion in the wheel set. The mass of the wheelset in moving toward its equilibrium point acquires kinetic energy in the yaw mode if damping or energy dissipation is less than critical. In this event the wheelset is displaced to the opposite side of the equilibrium point and the entire system of motions is reversed. Given the proper set of conditions, this motion may become a sustained harmonic oscillation with the sinusoidal peaks being clipped by contact between the rail and the wheel flange.

When rigid wheelsets are coupled in a truck thru the media of side frames, or rigid truck frames, the hunting tendency is transmitted to the truck and causes an oscillatory yawing motion of the truck about its center of rotation, or swivel. Continuous or semi-continuous motion of this nature is transmitted to the car body which then yaws about its center of gravity, or about the center plate of its second truck if that truck is not hunting.

A rigid wheelset is incapable of free curving when the radius of curvature $<dt/4cs$ where:

$d$ = Wheel diameter
$t$ = Wheel tread contact spacing
$c$ = Flangeway clearance
$s$ = Effective conicity of tread For relatively common conditions of $d=33$ inches, $t=59$ inches, $c=0.375$ inches, and $s=1:20$, the value of R is approximately 2200 feet.

For curves having a radius less than 2200 feet under the above conditions, the lead wheelset in a truck is guided around the curve by contact of the flange and the rail head. Inasmuch as the variation in wheel diameters is inadequate for free curving, the wheelset assumes a yawed attitude with the inside wheel tending to lead.

When wheelsets are coupled by side frames the entire truck is forced to assume a yawed attitude during curving. The force required to rotate the truck is transmitted through the flange of the outside lead wheel while the trailing axle tends to assume a quasi-radial location with respect to the curve. The optimum position when negotiating a curve is achieved when each wheel assumes a normal to the curve.

SUMMARY OF THE INVENTION

This invention overcomes or minimizes the problems set forth above.

In accordance with the present invention independent wheels are mounted on stub axles so that the wheels are independently rotatable with reference to each other. Laterally disposed wheels are connected by an axle bolster which defines and maintains the appropriate wheel spacing, and further serves as the upper suspension connection member. A pair of axle boxes is provided at each wheel to contain the suspension and to transmit suspension forces to the stub axle, while also providing means of maintaining assembly location.

Each of the axle bolsters is disposed to interface with a span bolster in a manner which permits the transferral of vertical loads from the span bolster to the axle bolster at points as far removed from the longitudinal center line of the axle bolster as practical. The load bearing interfaces are formed to allow a relative angular displacement between the span and axle bolsters, and are supplemented in this function by the telescoping engagement of arcuate interfaces between the span bolster and the axle bolster. This relative angular motion is focused along the longitudinal center lines of the bolsters and the lateral center lines of the axles.

A similar means of supporting the vertical load of the car body and providing rotational capability is utilized at the interface of the car body and the span bolster.

Accordingly there is provided a means to prevent hunting of the wheelset and to permit the desirable radial alignment of the axles during curve negotiation.

By decoupling the laterally spaced wheels, the major cause of hunting is eliminated. The wheels are now relatively free to roll on different diameters at differing angular velocities. The inherent yaw tendency is vastly reduced, its existance now being dependent on friction differences between bearings and on inertial effects on angular acceleration of the wheels.

On entering a curve, inertia tends to maintain a truck in longitudinal alignment with a car body, and in effect causes the outside leading wheel to roll on an increasing diameter. The lead axle bolster-wheel assembly is subjected to a yaw couple, either through the effects of gravity, or by flange contact of the outside lead wheel. The wheels will be in equilibrium and the couple eliminated when the axle bolster assumes a radial position. A similar situation occurs with the trailing axle.

Car body rocking, defined herein as roll motion which results in partial or complete center plate separation, occurs from the basic instability of the existing geometry of truck-car body connections. This geometry closely approaches that of an inverted pendulum. Under harmonic excitation the car body rocks on the truck bolster, with shifts of weight distribution occurring each half cycle. Non-uniform load transfer to the journal bearings creates moments which tend to cause wheel lifting.

Further features of the invention will hereinafter appear.

DESCRIPTION OF THE PREFERRED EMBODIMENT

Figure 1:
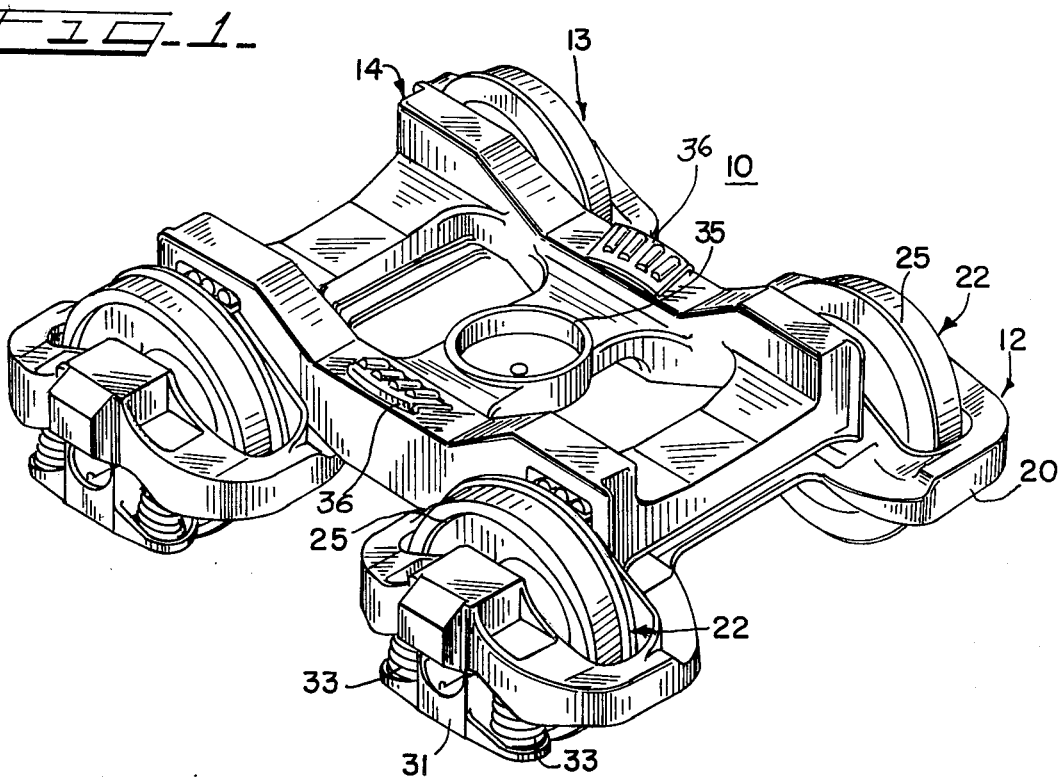
FIG. 1 is an isometric view of an improved railway truck according to the present invention.
Figure 2:
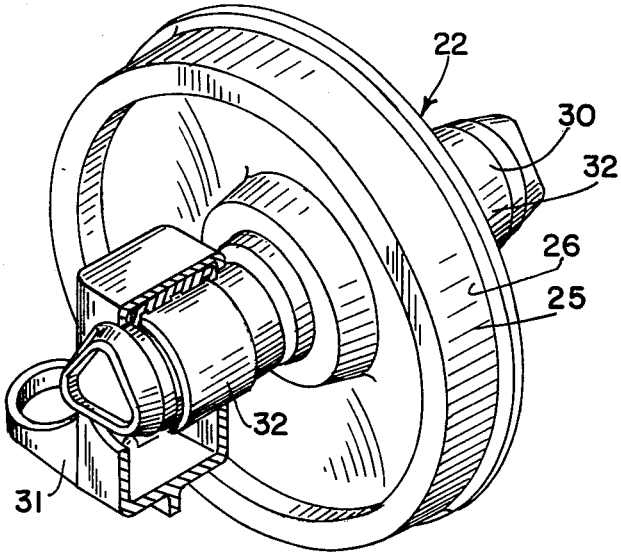
FIG. 2 is a fragmentary isometric view of the railway truck of FIG. 1, illustrating the stub axle and wheel assembly.
Figure 5:
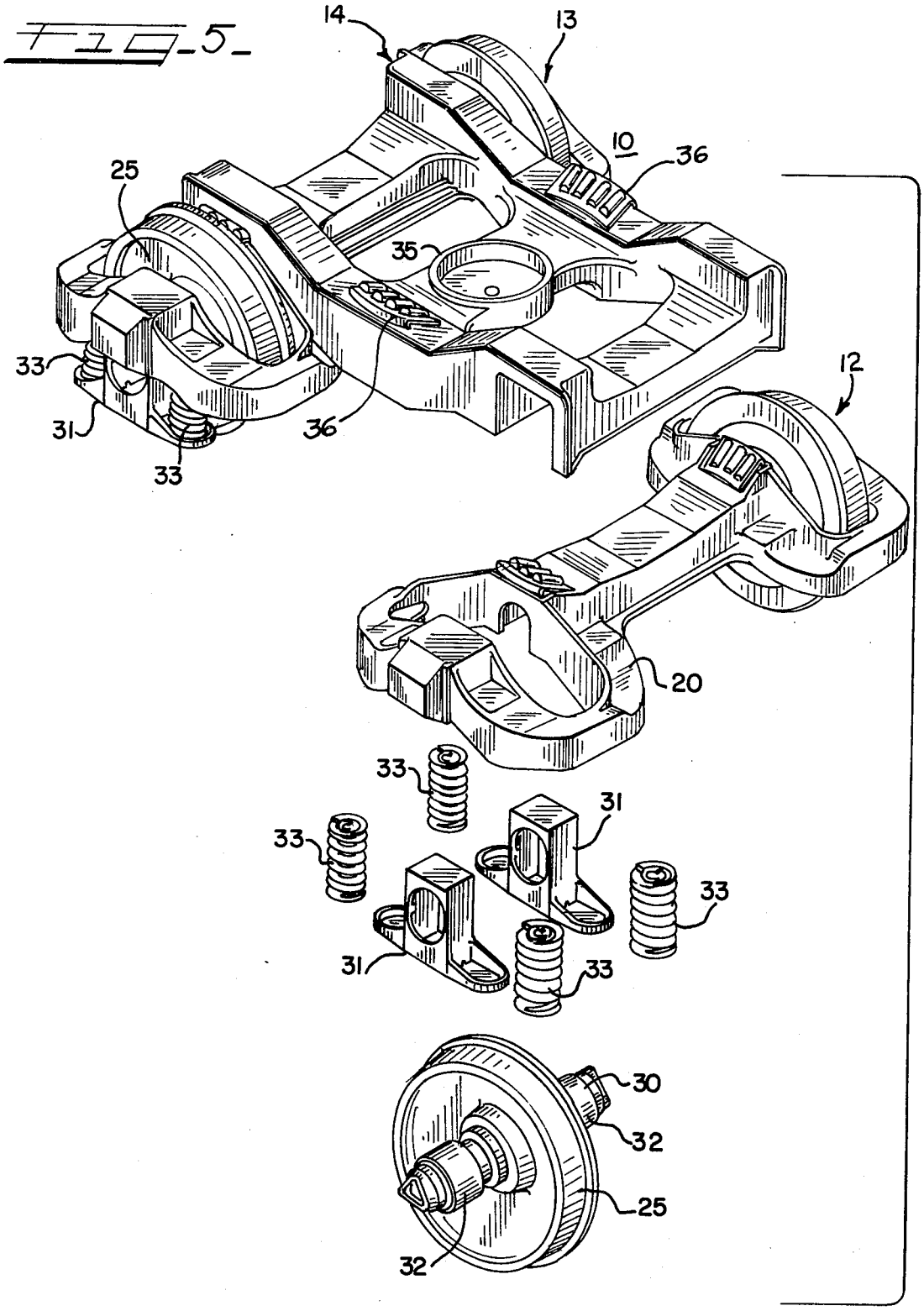
FIG. 5 is an exploded perspective of the railway truck of FIG. 1.

Referring now to the drawings, and particularly to FIGS. 1 and 5, there is illustrated an improved four wheel truck 10 according to the present invention and adapted for use on a railway freight car and the like. As therein illustrated there is provided a pair of longitudinally spaced apart axle bolster assemblies 12 and 13. The axle bolster assemblies 12 and 13 are identical and, accordingly, only one 12 is herein described in detail. The axle bolster assemblies 12 and 13 are interconnected by a span bolster 14.

Referring now to the axle bolster assembly 12, the axle bolster assembly 12 includes an axle bolster 20 with a wheel and axle assembly 22 mounted at laterally disposed ends thereof. Each wheel and axle assembly 22 includes a railway wheel 25 of conventional configuration having a tapered, conical, or otherwise profiled tread 26 adapted to ride on a rail 27, and further including a flange 28 also adapted to contact the rail 27 for steering of a railroad car on the tracks.

Each of the wheels 25 are independently rotatable, and in the illustrated embodiment each of the wheels 25 are pressed onto a stub axle 30, journaled relative to an axle box 31 in any suitable manner as through roller bearings 32. It will be understood however, that the wheels 25 may be mounted onto the stub axles 30 by suitable roller bearings to provide the independent wheeling of the wheels 25. Suitable load springs 33 are interfitted between the axle boxes 31 and the associated axle bolster 20.

The span bolster 14 maintains the longitudinal spacing of the axle bolsters 20, transmits vertical load through the axle bolsters 20 to the wheel and axle assemblies 22, and provides for connection to the body of a railway car. For this purpose in a known manner there is provided a center bearing 35 on the span bolster which will permit swiveling of the truck 10 relative to the car body. The load and weight of the car body is transmitted to the span bolster by spaced roller-type, or other low friction, side bearings 36 on which ride bearing areas of the car body bolster (not shown).

Figure 3:
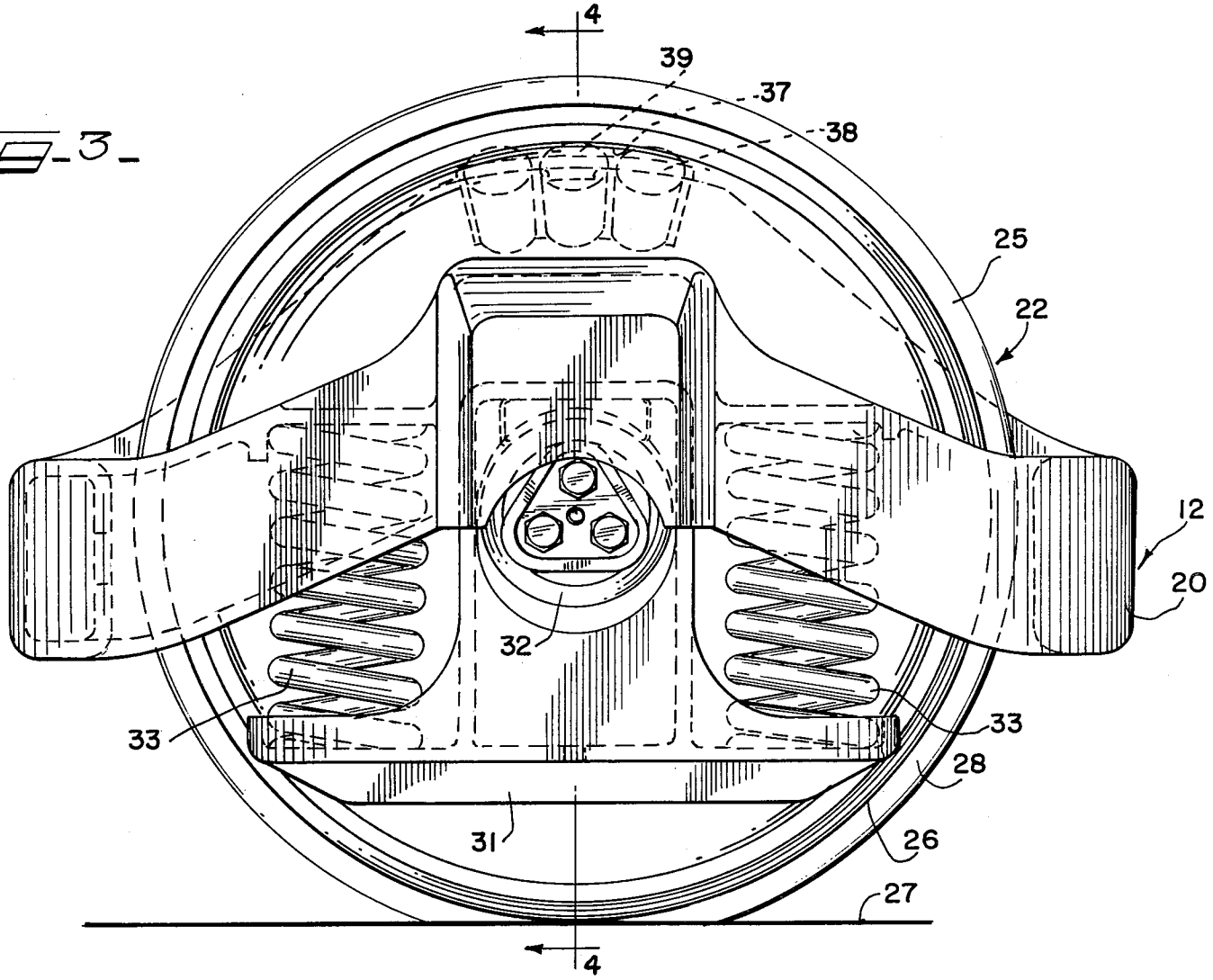
FIG. 3 is a fragmentary side view of the railway truck of FIG. 1.
Figure 4:
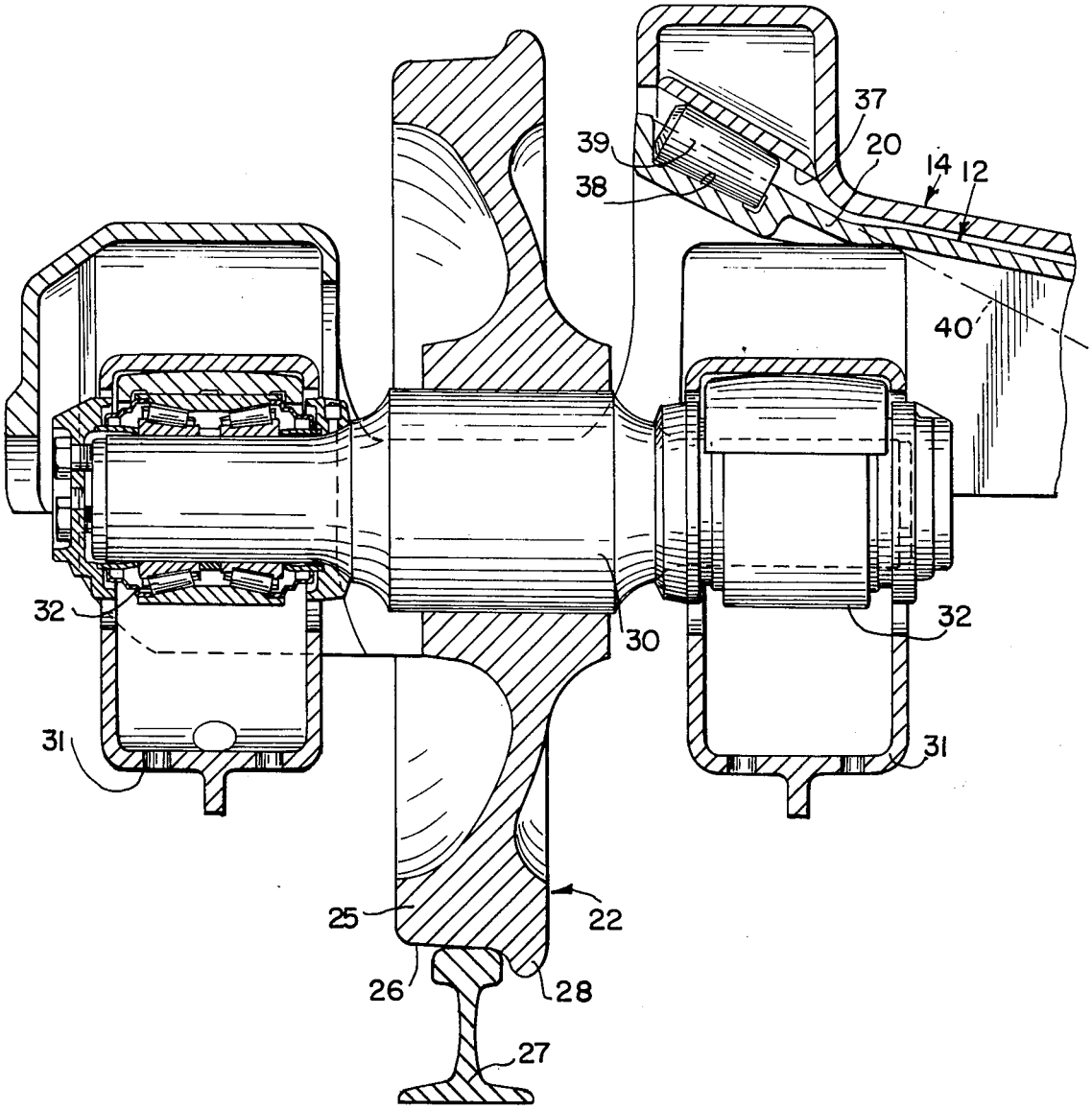
FIG. 4 is a fragmentary sectional view of the railway truck of FIG. 1.

Each of the axle bolsters 20 are disposed to interface with the span bolster 14 in a manner which permits the transferral of vertical loads from the span bolster to the axle bolster at points as far removed from the longitudinal center line of the axle bolster as practical. The load bearing interfaces are formed to allow a relative angular, low friction displacement between the span and the axle bolsters, and are supplemented in this function by the telescoping engagement of concavities or circular recesses on the span bolster, and cooperating convexities or circular projections in the upper surfaces of the axle bolsters. In the illustrated embodiment a plurality of rollers 39 are positioned between the complimentary concavity 37 and convexity 38 to define a segmented roller bearing. The concavity 37 and convexity 38 are conical, as best illustrated in FIGS. 3 and 4 with the apex of the cone 40, FIG. 4, extending inwardly of the truck and downwardly focused along the longitudinal center line of the bolsters and the lateral center line of the axles.

It should be understood that the arrangement described above constitutes the preferred embodiment and that many adaptations and modifications may be made without departing from the spirit of the invention.

What is claimed is:

1. A four wheel truck for a railway freight car and the like comprising a pair of longitudinally spaced apart axle bolsters;

independently rotatable wheels mounted at opposite ends of each axle bolster;

a span bolster connecting each of said axle bolsters; and mounting means mounting said axle bolsters for independent movement relative to each other and to said span bolster for yawing movement about respective vertical axes located approximately on the respective axis of rotation of said wheels at each end of said axle bolster and substantially midway of said wheels at each end of said axle bolster.

2. A four wheel truck as set forth in claim 1 wherein said span bolster includes transversely spaced side frame sections each overlying said pair of axle bolsters at transversely spaced points providing for vertical load transfer between said axle bolsters and said span bolster and wherein said mounting means comprises a low friction mounting at each of said points.

3. A four wheel truck as set forth in claim 2 wherein said low friction mounting means includes a concave surface in said span bolster at each of said points, and a complementary convex surface on the span bolsters at each of said points.

4. A four wheel truck as set forth in claim 3 and including a plurality of rollers between said concave surface and said convex surface defining a roller bearing.

5. A four wheel truck as set forth in claim 3 wherein said concave surface and said convex surface are each inclined inwardly and downwardly.

* * * * *